US005211864A

United States Patent [19]

Godlove

[11] Patent Number: 5,211,864

[45] Date of Patent: May 18, 1993

[54] POLYMERIC ALCOHOLS WAX/TONER CLEANING BLADE LUBRICANT

[75] Inventor: Ronald E. Godlove, Bergen, N.Y.

[73] Assignee: Xerox Corporation, Stamford, Conn.

[21] Appl. No.: 753,498

[22] Filed: Sep. 3, 1991

[51] Int. Cl.[5] ..... C10M 129/04; G03G 15/08

[52] U.S. Cl. ..... 252/52 R; 355/299; 355/296

[58] Field of Search ..... 355/299, 296; 252/56 S, 252/52 R

[56] References Cited

U.S. PATENT DOCUMENTS

| | | | |
|---|---|---|---|
| 3,552,850 | 1/1971 | Royka et al. | 355/15 |
| 4,158,498 | 6/1979 | Ohmori | 355/299 |
| 4,519,698 | 5/1985 | Kohyama et al. | 355/299 |
| 4,825,249 | 4/1989 | Oki et al. | 355/299 |
| 4,883,736 | 11/1989 | Hoffend et al. | 430/110 |
| 4,958,197 | 9/1990 | Kinashi et al. | 355/299 |
| 4,970,560 | 11/1990 | Lindblad et al. | 355/299 |
| 4,971,882 | 11/1990 | Jugle | 430/110 |
| 5,117,264 | 5/1992 | Frankel et al. | 355/299 |

*Primary Examiner*—Jacqueline V. Howard
*Attorney, Agent, or Firm*—Tomera L. Fair

[57] ABSTRACT

A lubricant slurry made from a combination of a polymer alcohol wax and a toner in isopropyl alcohol or the like. This lubricant slurry is applied to the cleaning blade prior to assembly of the cleaning blade into the printing machine to reduce the frictional forces between the photoreceptor and the cleaning blade edge at start-up. The triboelectrical properties of the lubricant slurry provide strong adhesion to the cleaner blade edge.

19 Claims, 1 Drawing Sheet

POLYMERIC ALCOHOLS WAX/TONER CLEANING BLADE LUBRICANT

BACKGROUND OF THE INVENTION

This invention relates generally to an apparatus or device and process for cleaning in an electrostatographic printer, and more particularly, a cleaning blade lubricant used therein to prevent the build up of frictional forces between the cleaning blade and the photosensitive surface.

In the process of electrophotographic printing, a photoconductive surface is charged to a substantially uniform potential. The photoconductive surface is imagewise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a sheet of support material and permanently affixed thereto.

This process is well known and useful for light lens copying from an original and printing applications from electronically generated or stored originals, and in ionography.

Various methods and apparatus may be used for removing residual particles from the photoconductive imaging surface. Hereinbefore, a cleaning brush, a cleaning web, and a cleaning blade have been used. Both cleaning brushes and cleaning webs operate by wiping the surface so as to affect transfer of the residual particles from the imaging surface thereon. After prolonged usage, however, both of these types of cleaning devices become contaminated with toner and must be replaced. This requires discarding the dirty cleaning devices. In high-speed machines this practice has proven not only to be wasteful but also expensive.

The shortcomings of the brush and web made way for another now prevalent form of cleaning known and disclosed in the art—blade cleaning. Blade cleaning involves a blade, normally made of a rubberlike material (e.g. polyurethane) which is dragged or wiped across the imaging surface to remove the residual particles from the imaging surface. Blade cleaning is a highly desirable method, compared to other methods, for removing residual particles due to its simple, inexpensive structure.

However, there are certain deficiencies in blade cleaning, which are primarily a result of the frictional sealing contact that must occur between the blade and the surface. One such deficiency is often experienced prior to initial start-up of the electrophotographic printing machine cleaning process. At start-up, the cleaning apparatus in the electrostatographic printing machine, has no initial lubrication between the cleaning blade edge and the photosensitive imaging surface. This lack of lubrication allows the build-up of frictional forces between the cleaning blade edge and the imaging surface. Dynamic friction is the force that resists relative motion between two bodies that come into contact with each other while having separate motion. This type of frictional problem occurs in both cartridge assemblies used in customer replacement units (i.e. CRUs) and permanently attached printer cleaning systems. The friction between the blade edge and the imaging surface becomes so great at start-up that it causes the cleaning blade to "foldover" (i.e. the blade edge flips over onto itself). Foldover causes the blade material to experience high stress thereby damaging the cleaning blade. Foldover also affects the ability of the cleaning blade edge to form a proper sealing contact with the imaging surface for cleaning. As a result of foldover affects such as these, the cleaning blades often fail prior to their first use which leads to frequent blade replacement. It is an object of the present invention to reduce the build up of the frictional forces at start-up in order to reduce the amount of cleaning blade replacement required due to damaged and failed cleaning blades. It is believed that the present invention aids in correcting misalignment between the blade and the photoreceptor surface created by the photoreceptor roller's misalignment providing a better sealing contact.

Various blade lubricating materials have been attempted to provide sufficient adherence to the blade surface. However, it has been found difficult to keep the lubricant adhered to the cleaning blade, especially when the lubricant is applied prior to shipping and packaging. Solid lubricants (e.g. Kynar) tend to fall off the cleaning blade and liquid lubricants, when dry, tend to become brittle and flake off the cleaning blade edge prior to installation in the electrostatographic printing machine. The portion of lubricant remaining at the time of installation of the blade is often not effective to reduce the build-up of friction when the cleaning blade and the imaging surface make initial contact at start-up. Some reasons for this ineffectiveness are that the lubricant remaining is not enough to reduce the friction, or there is no lubricant remaining on the cleaning edge when it contacts the imaging surface. It is an objective of the present invention for the lubricant slurry to remain adhered to the cleaning blade edge after drying and operate effectively upon installation.

It is also an object of this invention to decrease the likelihood of blade damage and failure upon initial start-up conditions.

It is a further objective of the invention to prevent the introduction of any new ingredients not already present in the process, thereby eliminating the possibility of unexpected subsystem interactions such as photoreceptor filming, cometing, and the like.

The following disclosures may be relevant to various aspects of the present invention and may be briefly summarized as follows:

U.S. Pat. No. 3,552,850 to Royka et al. discloses an imaging system which employs a reusable electrostatographic imaging surface cleaning station comprising at least one self-adjusting flexible cleaning blade for pressure contact cleaning of the imaging surface and a means to supply a dry solid lubricant to the imaging surface. The patent states that a dry solid lubricant may be supplied to an interface between the cleaning blade and the imaging surface by, for example, having the lubricant in a solid form and having it intimately mixed with toner which is supplied to the imaging surface during development of the electrostatic image.

U.S. Pat. No. 4,519,698 to Kohyama et al. discloses an image forming apparatus which includes a cleaning blade and a drum lubricant. The patent states that a recess is formed at part of an outer circumferential surface that holds lubricant and the tip end of the cleaning blade feeds the lubricant in the recess to part of the outer circumferential surface of the photosensitive drum which is brought into contact with the cleaning blade to form a thin film of lubricant by rotation of the drum. The lubricant is mixed with the developer and its thickness is kept uniform upon the photoresponsive drum.

U.S. Pat. No. 4,883,736 to Hoffend et al. discloses a toner composition of resin particles, pigment particles and a wax component comprised of polymeric alcohols.

U.S. Pat. No. 4,958,197 to Kinashi et al. discloses a cleaning blade for an image forming apparatus which is formed of a rubber elastomer which contains, or has adhered on the surface thereof, an antistatic agent in an amount effective to prevent electrification. The patent states that by virtue of the antistatic agent on the cleaning blade, scattering of toner particles adhering to the blade edge surface is realized within a very short time. The toner particles serve as a lubricant to prevent the blade from excessive stress due to friction.

U.S. Pat. No. 4,970,560 to Lindblad et al. discloses a lubricated metal cleaning blade for use in dry electrophotographic processes wherein a hardened material coating is electro-deposited onto a carbon steel cleaning blade. The patent states that the coating process is selected to provide a microporous surface which is sealed with sub-micron size particles of flourocarbons, heat treated to create a smooth, slippery surface, while the hardened metal coating provides wear resistance to friction encountered during the cleaning operation. In addition, it is disclosed that the process gives the blade improved hardness, protection against chemical attack, better abrasion resistance, permanent lubricity (until the blade edge is undesirably worn), provides a marked increase in life, and appears to improve the squareness of edges on the blades.

U.S. Pat. No. 4,971,882 to Jugle discloses a toner composition comprised of resin particles, pigment particles, a charge enhancing additive, and a mixture of a charge enhancing additive and a wax component comprised of an alkylene or polymeric alcohol. The patent states that the toner and developer compositions contain a wax mixture wherein the wax includes polyethylene, polypropylene and linear polymeric alcohol available as Unilin® comprised of a fully saturated hydrocarbon backbone with at least 80 percent of the polymeric chains terminated at one chain end with a hydroxyl group. The patent discloses that the toner and developer composition enables images of excellent quality inclusive of acceptable resolutions with no toner spots on the photoreceptor.

SUMMARY OF INVENTION

Briefly stated, and in accordance with one aspect of the present invention, there is provided a method of lubricating a cleaning blade edge, prior to machine start-up and prior to contact between the cleaning blade edge and the photoreceptor imaging surface, used in a printing machine of the type having images developed thereon, comprising the steps of: combining a wax component and toner in a solution forming a slurry, applying the slurry to the cleaning blade edge prior to assembly and adherence of the slurry to the cleaning blade edge.

Pursuant to another aspect of the present invention, there is provided a lubricant applied to a cleaning blade edge, prior to machine start-up and prior to contact between the cleaning blade edge and the photoreceptor used in a printing machine of the type having images developed thereon, comprising: a wax component, a toner, and an evaporatable solution to which said toner and said wax component are admixed to form a slurry.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same. Although the cleaning apparatus of the present invention is particularly well adapted for use in an electrophotographic printing machine, it should become evident from the following discussion that it is equally well suited for use in a wide variety of devices and is not necessarily limited to the particular embodiments shown herein.

Figure 1:
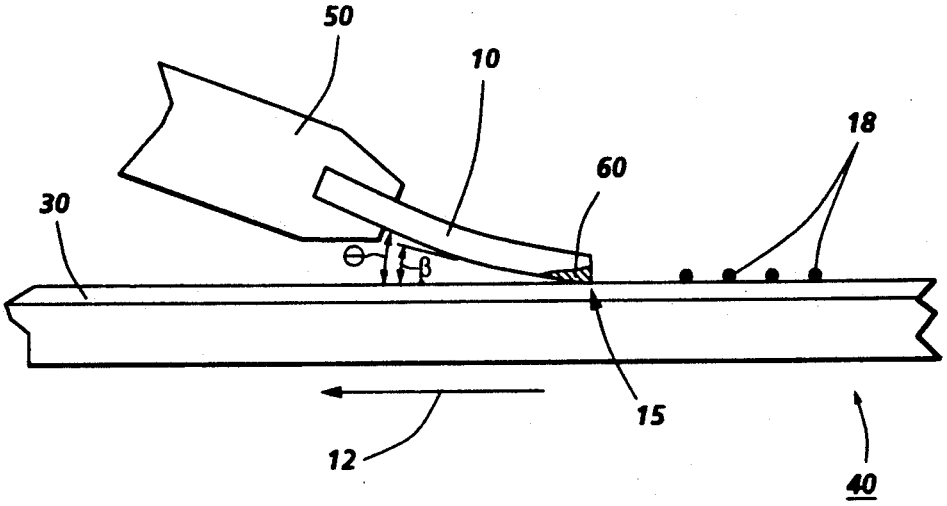
FIG. 1 is a schematic elevational view depicting one exemplary cleaning blade, incorporating the features of the present invention therein.

Referring now to FIG. 1 which shows a cleaning blade 10 in a cleaning relationship with a photoconductive surface 30 of belt 40. A blade holder 50 is provided to support blade 10 in frictional sealing contact with surface 30. Cleaning blade edge 15 is located where blade 10 and imaging surface 30 meet to form a sealing contact. The lubricant slurry 60 is applied to the cleaning blade edge 15 and the surrounding blade material by dipping the blade in the lubricant slurry 60 before the blade 10 is placed in the blade holder 50. In the doctoring mode that is depicted in FIG. 1, the cleaning blade edge 15 acts as a scraper in removing the residual particles 18 from the imaging surface 30. The cleaning blade edge 15 is in frictional contact with the imaging surface 30 as the imaging surface 30 moves in the direction 12 indicated.

The blade holder angle $\theta$ typically ranges from about 10° to about 25°. In the case of the cleaning blade 10 in the wiping mode, $\theta$ would typically range from 90° to 110° in FIG. 1. The working angle $\beta$ of the elastomeric blade 10 ranges from about 5° to about 15°. Typically the free length of blade 10 extending from blade holder 50 is about 0.4 inches.

Figure 2:
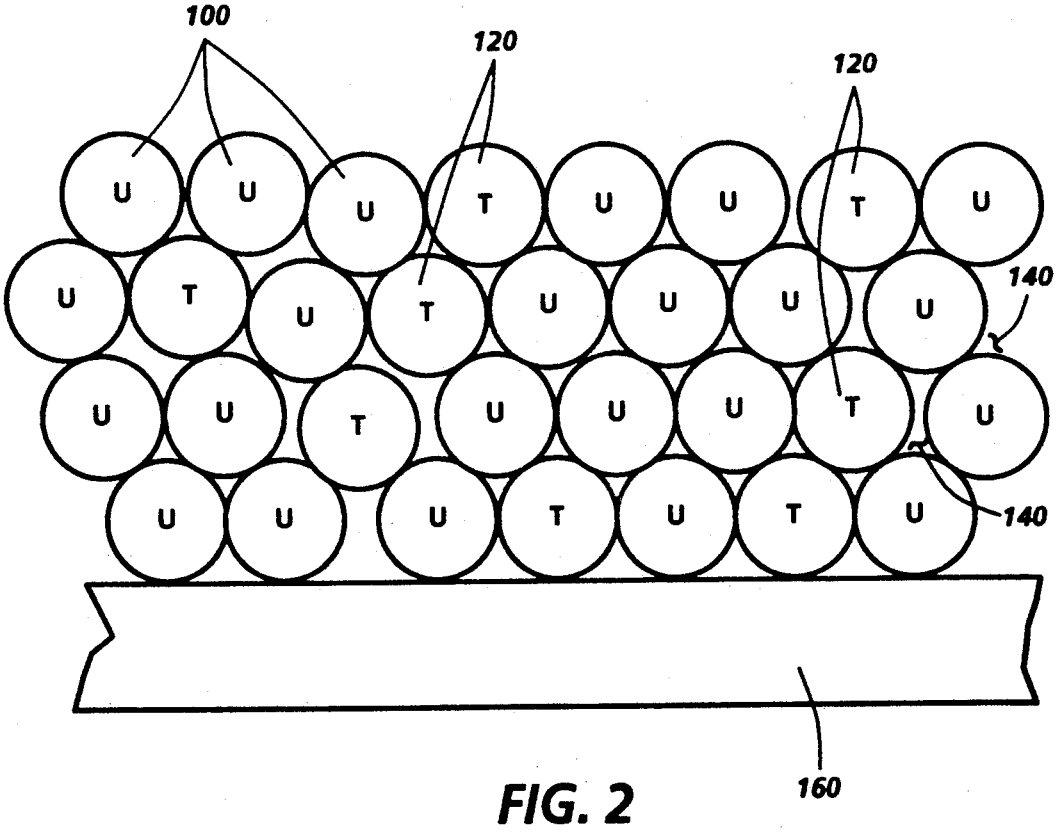
FIG. 2 is a schematic presentation of the lubricant slurry attached to the cleaning blade edge.

Referring now to the specific subject matter of the present invention. FIG. 2 shows the cleaning blade material with the lubricant slurry applied thereon.

The present invention is a formula for a xerographic process cleaning blade lubricant that decreases the likelihood of blade damage and failure upon initial start-up conditions. The formulation of the proposed lubricant contains two solid ingredients mixed together with isopropyl alcohol 140 or an isopropanol based liquid 140 or any other liquid able to evaporate which does not soften, dissolve or otherwise modify the toner and wax particles, to form a wet lubricant slurry. The cleaning edge (15, in FIG. 1) of the blade and about an eighth to a sixteenth of an inch of the blade body 160 adjacent to the cleaning edge is dipped into the wet lubricant slurry for purposes of coating that region of the blade. The two solid ingredients are toner 120 (indigenous to the particular process) and a wax component or substance (e.g. Unilin ® or U-Add) 100. The wax component is comprised of polymeric alcohols of the formula $Ch_3(CH_2)_nCH_2OH$ where n is a number of from about 30 to about 300 and H is a polyhydroxy compound. The proportion of the wax component 100 to toner 120 is 75% wax component to 25% toner, those proportions being determined by weight. The constituents of the toner are resin (e.g. styrenebutadiene) and pigment (e.g. carbon black) particles. The toner 120 particles are approximately 10 microns in diameter and the wax component 100 particles are about 7 to 8 microns in diameter. (It is noted that the trend is toward the use of toner particles that are smaller (e.g. 4.7 microns) than 10 microns. The present invention would still function as described with toner particles smaller than 10 microns.) The proportion of mixed solids 100, 120 to liquid (isopropyl alcohol 140 or an isopropanol based liquid 140) are 350 grams solids to a liter of liquid.

EXAMPLE

The usefulness of the present pre-lubricant invention that reduces the friction/adhesion between the blade and the photoreceptor surface can best be explained in comparison with other slurry mixtures. In the way of background, a description of a testing procedure used in making the following comparisons is provided herein.

After preliminary testing of various lubricating agents, the testing field was narrowed to four different compositions of Unilin ®, (e.g. polymeric alcohols) otherwise known as U-Add, and toner. They were: 100% Unilin ®/0% toner; 25% Unilin ®/75% toner; 50% Unilin ®/50% toner; and 75% Unilin ®/25% toner. In each case, the percentage of Unilin ® to toner was determined by weight, not volume. U.S. Pat. No. 4,883,736 to Hoffend et al. is totally incorporated herein by reference and particularly the description of the polymeric alcohols composition for U-Add (Unilin ®) found in Example II of U.S. Pat. No. 4,883,736. Additionally, the proportion of solids to Xerox Film Remover (XFR) was identical to the ratio of 350 grams of solids to 1.0 liter of Xerox Film Remover (XFR). Four centimeter long samples were cleaned and coated and tested for each of the composition categories mentioned above. All of the samples were tested for proneness to foldover and wear in a wear/test fixture. The fixture was adjusted for an unloaded blade angle of 24 degrees to the tangent of the point of contact with circumference of a 1.5 inch diameter specular finish pyrex glass cylinder. Each sample was loaded (by unsprung weight) at 43.75 grams/cm. Each sample was four centimeters long, for a total load of 175 grams. The blade engaged the cylinder at a position corresponding to 4:30 on a clock face. The direction of rotation of the cylinder was such as to operate the blade in "doctor" mode (with respect to the the same clock face, counter-clockwise). The surface speed of the outer circumference of the glass cylinder was 6.7 inches/second. The ambient conditions were 71° F. and 52% relative humidity.

In each test, the sample was positioned 0.5 inches away from the cylinder. The cylinder was brought up to speed and the support holding the blade away from the cylinder pulled away. The blade was allowed to freely accelerate (by gravity) until engaging the cylinder. The test was allowed to run until a sustained oscillation of the blade holder/blade load assembly was seen to occur. At that point, the running time was recorded and the test terminated. If the blade test ran for ten minutes and no sustained oscillation was seen to occur, the test was terminated and 10 minutes noted as the running time. If the first three sample test of a given lubricant/extension combination ran for 10 minutes, the last two were allowed to run for up to 20 minutes maximum. Throughout the duration of each test, an air knife at the 10:00 position was operated to dislodge any chunks of lubricant that might break off from the blade and otherwise collect upstream of the blade cleaning edge. Prior to each sample test being run, the glass cylinder was cleaned by scrubbing with a cellulose sponge charged with a concentrated solution of a commercial detergent (Alconox TM) and water. This was then removed with a paper towel, and the cylinder rinsed with eight successive surfaces of cellulose sponge charged with water. Each sponge surface was wiped contrary to the motion of the cylinder running at 6.7 inches/second in a "web/cleaner" type action. Each sponge was thoroughly rinsed under running water before being used to rinse the cylinder. The cylinder was then wiped dry with lint free cheesecloth. The cylinder was left running while the air gun was operated for about 10 seconds to blow off any residual lint. This is a method used to determine the usefulness of the lubricant in reducing damage to the sample blade material. The problem with a Unilin ® only pre-lubricant is that it is a brittle and fragile material after the alcohol has evaporated. The slightest jar, or bump is enough to cause it to fall off from the blade in chunks. Little at all remains on the blade after the blade has initially contacted the photoreceptor, be the photoreceptor moving or not. The deformation of the blade that results when it physically engages the photoreceptor is sufficient to drive off most of the Unilin ® coating. Vibrations resulting from the blade being loaded by the moving photoreceptor surface are even more dangerous to the amount of Unilin ® that remains to provide lubrication. Microscopic examination of blades that had been coated with Unilin ® alone revealed that as the alcohol evaporates, surface tension forces pull the suspended particles of Unilin ® away from the cleaning edge of the blade. This is especially detrimental, because that is the part of the blade that engages the photoreceptor, and therefore just that part of the blade where one would hope that the pre-lubricant would remain if anywhere on the blade at all. The same surface tension forces have the same effect on the toner/Unilin ® mixture, but to a lesser extent.

The reason that the Unilin ® only mixture is so fragile is that all of the particles are of like composition, that when a fracture within the structure occurs and induces static electrical charges, the charges are of like polarity, and provide no electrostatic forces to hold the particles together. When a fracture occurs within the structure of the toner/Unilin ® mixture of particles, the induction of static charge is different in polarity for the toner particles than for that of the charges induced on the Unilin ® particles. Unlike charges being attractive, the mixture tends to remain cohesive, despite the occurrence of fractures. This reasoning is suggested as a result of what is seen under the microscope when the mixture of toner and Unilin ® particles are disturbed with a scalpel blade. Instead of the dislodged fractured pieces flying off the blade, they move out of the way of the blade, but remain adhered to the rest of the coating. The basis for this suggested explanation is: 1) Toner composition is designed to capitalize on the ability of a material to easily take and retain a static charge; and 2) When an agglomeration of adhered particles is broken apart, the particles are rubbed together, and then separated. This has the result of inducing charges in the separated particles.

It is also believed that the reason that the Unilin ®/-toner mixture does not migrate away from the cleaning edge during the drying process to the extent that the Unilin ® only pre-lubricant does during the drying process is that static charge builds up on the toner particles as they are dragged along by the surface tension forces. Since toner particles and the blade material are not located at the same point in the triboelectric series, the charges on the toner particles and the blade material are different in polarity, and this causes attractive forces to be set up between the toner particles and blade material. An increase in the force of attraction between the toner particles and the blade material is an increase in the normal force being applied between two sliding bodies (i.e., the sliding bodies are the toner particles and the surface of the blade material). An increase in normal force results in an increase in the frictional force, thereby shortening the distance traversed by the particles from that which would occur had there been no attractive electrostatic forces at work. As a result, more of the particles remain nearer to the cleaning edge of the blade in spite of the surface tension forces.

The present composition containing Unilin ® as a blade lubricant has limitations regarding inhibiting blade wear and foldover as previously described. However, the fact that the Unilin ® is already in the toner reduces the limitation because as a substance already incorporated in the toner, there does not seem to be the addition of any risks of unforeseen subsystem interactions.

Incorporating toner into the lubricant slurry gives the lubricant coating greater likelihood of remaining on the cut side of the blade. It follows therefore that there would be less chance of toner (dispensed during the line simulator test) being carried out of the process by such flaking of lubricant deposits. It also introduces the best blade lubricant of all, that is toner, into the blade lubricant, and in such a way as to virtually guarantee that some toner remains in the residual layer of lubricant on the blade even if the bulk does flake off. Of the three different relative concentrations of Unilin ® to toner tried, that consisting of 75% Unilin ® and 25% toner yielded samples that totally resisted the formation of any visible (under a microscope) signs of blade wear or tear. The same admixture exhibited superior ability to remain on the sample before, during and after.

Most of the failed blades from the field, when observed under a microscope, showed extensive features of sustained wear to the cut edge. In CRUs (customer replacement units) the units are placed through a simulator test before being shipped to the customer, to test for any problems with the cartridge prior to reaching the customer. Most blades, even those that survived the simulator testing are being highly stressed, and this may compromise the performance of such blades in the field. The averages for these wear rate figures for each type of lubricant evaluated are:

100% Unilin ®/0% toner, average wear rate=127
25% Unilin ®/75% toner, average wear rate=50
50% Unilin ®/50% toner, average wear rate=48.2
75% Unilin ®/25% toner, average wear rate=13.4.

It was noted that upon initial contact between the sample and the cylinder, for all varieties of lubricant consisting of Unilin ® and toner except the 25% Unilin ®/75% toner combination, strike (explain) and slip (explain) cycles occurred for a period of about one (1) to two (2) seconds.

Comparison of the four composites readily establishes that the 100% Unilin ® coating suffered the greatest loss of lubricant on the cut side of the blade. Also as readily revealed, is the fact the 75% Unilin ®/25% toner lubricant admixture lost the least amount of lubricant in this most important region. A build-up of lubricant occurred during testing of the slurry on the blade. This build-up occurred as the lubricant passed under the cleaning edge, and was tribo-electrically attracted to and deposited upon the lubricant already present there. It is believed that such attraction might be responsible for the superior clinging powers of the present invention lubricant admixture.

Although the invention has been described with reference to specific preferred embodiments, it is not intended to be limited thereto. Rather, those skilled in the art will recognize that variations and modifications may be made therein which are within the spirit of the invention and the scope of the claims.

In recapitulation, it is evident that the lubricant slurry of the present invention is a Unilin ®/toner cleaning blade lubricant that reduces or prevents the frictional forces that build up upon initial start-up between the cleaning blade edge and the imaging surface. This lubricant slurry is composed of 75% Unilin ® and 25% toner, those portions being determined by weight. The lubricant of the present invention has the unique ability to strongly adhere to the cleaning blade after drying and provides the added benefit of not introducing any new ingredients, not already present in the process, thereby eliminating the possibility of unexpected subsystem interactions such as photoreceptor filming, cometing, and the like. Furthermore, it is believed that the present invention aids in compensating for misalignment between the blade and the photoreceptor surface created by the photoreceptor roller's misalignment thus, providing a better sealing contact. (i.e. The present invention reduces the increased frictional force caused by misalignment of the blade, thus, preventing blade foldover, which is a common type of blade failure.)

It is, therefore, apparent that there has been provided in accordance with the present invention, polymeric alcohols wax component/toner cleaning blade lubricant for preventing the build up of frictional forces between the cleaning blade and the photosensitive surface that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method of lubricating a cleaning blade edge prior to machine start-up and prior to contact between the cleaning blade edge and a photoreceptor used in a printing machine of the type having images developed thereon, comprising the steps of:

forming a slurry from a polymeric alcohol and toner in an evaporatable solution; and applying the slurry to the cleaning blade edge before an edge of the cleaning blade contacts the photoreceptor used in the printing machine.

2. A method as recited in claim 1, wherein the polymeric alcohol has a particle size of about seven to eight microns in diameter.

3. A method as recited in claim 1, wherein the toner particle has a size of about ten microns in diameter.

4. A method as recited in claim 1, wherein the slurry adheres to the cleaning blade edge triboelectrically.

5. A method of lubricating a cleaning blade edge prior to machine start-up and prior to contact between the cleaning blade edge and a photoreceptor used in a printing machine of the type having images developed thereon comprising the steps of:

forming a slurry from about 75 percent by weight of a polymeric alcohol and about 25 percent by weight of a toner in an evaporatable solution; and applying the slurry to the cleaning blade edge before an edge of the cleaning blade contacts the photoreceptor used in the printing machine.

6. A method as recited in claim 5, wherein the toner material of said slurry is chosen from the group consisting of resin particles and pigment particles.

7. A method as recited in claim 1, wherein the polymeric alcohol has linear polymeric alcohols of the formula $CH_3(CH_2)_nCH_2OH$, wherein n is a number of from about 30 to about 300.

8. A method in claim 1, wherein the polymeric alcohol has a number average molecular weight of about 700.

9. A method as recited in claim 5, wherein the evaporatable solution is an alcohol solution.

10. A method as recited in claim 9, wherein the alcohol solution is an isopropyl alcohol based liquid.

11. A cleaning blade, comprising an elastomeric member having an edge thereon with the edge being coated with a lubricant to reduce frictional forces on the edge wherein the lubricant includes:

a polymeric alcohol;

a toner; and an evaporatable solution having the toner and the polymeric alcohol admixed to form a slurry.

12. A cleaning blade having a lubricant as recited in claim 11, wherein the toner has a particle size of about ten microns in diameter.

13. A cleaning blade having a lubricant as recited in claim 11, wherein the polymeric alcohol has a particle size of about seven to eight microns in a diameter.

14. A lubricant as recited in claim 11, wherein the toner material of said slurry is chosen from the group consisting of resin particles and pigment particles.

15. A cleaning blade having a lubricant as recited in claim 11, wherein the polymeric alcohol has linear polymeric alcohols of the formula $CH_3(CH_2)_nCH_2OH$, wherein n is a number of from about 30 to about 300.

16. A cleaning blade having a lubricant as recited in claim 11, wherein the polymeric alcohol has a number average molecular weight of about 700.

17. A lubricant as recited in claim 11, wherein the evaporatable solution in an alcohol solution.

18. A lubricant as recited in claim 17, wherein the alcohol solution is an isopropyl alcohol based liquid.

19. A cleaning blade having an edge coated with a lubricant for reduction of friction forces, wherein the lubricant comprises:

a 75 percent by weight of polymeric alcohol;

a 25 percent by weight of a toner; and an evaporatable solution having the toner and the polymeric alcohol admixed to form a slurry.

* * * * *